US008863837B2

(12) United States Patent
Bender et al.

(10) Patent No.: US 8,863,837 B2
(45) Date of Patent: Oct. 21, 2014

(54) PLUNGER LIFT CONTROL SYSTEM ARRANGEMENT

(75) Inventors: Robert E. Bender, Evergreen, CO (US); David A. Green, Highlands Ranch, CO (US)

(73) Assignee: Well Master Corp, Golden, CO (US)

( * ) Notice: Subject to any disclaimer, the term of this patent is extended or adjusted under 35 U.S.C. 154(b) by 206 days.

(21) Appl. No.: 13/374,830

(22) Filed: Jan. 17, 2012

(65) Prior Publication Data

US 2012/0193091 A1 Aug. 2, 2012

Related U.S. Application Data

(60) Continuation-in-part of application No. 12/460,099, filed on Jul. 14, 2009, now Pat. No. 8,162,053, which is a continuation-in-part of application No. 12/217,756, filed on Jul. 8, 2008, now Pat. No. 7,793,728, and a continuation-in-part of application No. 11/715,216, filed on Mar. 7, 2007, now Pat. No. 7,748,448, which is a continuation of application No. 11/350,367, filed on Feb. 8, 2006, now Pat. No. 7,395,865, application No. 13/374,830, which is a continuation-in-part of application No. 12/807,808, filed on Sep. 14, 2010, now Pat. No. 8,607,880, which is a continuation-in-part of application No. 12/217,756, which is a division of application No. 11/350,367.

(60) Provisional application No. 61/461,402, filed on Jan. 14, 2011, provisional application No. 60/593,914, filed on Feb. 24, 2005.

(51) Int. Cl.
*E21B 43/12* (2006.01)
*E21B 47/16* (2006.01)
*F04B 47/12* (2006.01)

(52) U.S. Cl.
CPC ..... *E21B 43/121* (2013.01); *F04B 47/12* (2013.01)
USPC ..... 166/250.15; 166/53; 166/68; 166/105.2; 166/373

(58) Field of Classification Search
CPC combination set(s) only.
See application file for complete search history.

(56) References Cited

U.S. PATENT DOCUMENTS

2012/0285702 A1* 11/2012 Rytlewski ..... 166/373

* cited by examiner

*Primary Examiner* — Zakiya W Bates
(74) *Attorney, Agent, or Firm* — Don Halgren

(57) ABSTRACT

A plunger lift control system for improving the output efficiency of an oil or gas well by a real-time reporting arrangement, the system comprising: a tubing string having an upper end and a lower end, the tubing string arranged within a well casing for receiving a plunger traveling therethrough, a plunger having a sound generating function therewith, so as to transmit a real-time lower-end location signal from the plunger to a signal sensor and processor arranged in communication with a system controller arranged at the upper end of the tubing.

18 Claims, 3 Drawing Sheets

PLUNGER LIFT CONTROL SYSTEM ARRANGEMENT

BACKGROUND OF THE INVENTION

Field of the Invention

This invention relates to the operation of oil and gas wells, and more particularly to systems for increasing the production of resources from those wells, and claims the benefit of provisional application 61/461,402, filed 14 Jan. 2011, this application also being a continuation-in-part of application Ser. No. 12/460,099 filed Jan. 14, 2012, which is a re-filing of Ser. No. 12/313,279, and is a continuation-in-part application of Ser. No. 11/715,216 and also of Ser. No. 12/217,756, which is a continuation of Ser. No. 11/350,367, now U.S. Pat. No. 7,395,865 which was based upon Provisional Patent Application 60/593,914,filed 24 Feb. 2005, each of which Is incorporated herein by reference in its entirety, and also is a C-I-P of application Ser. No. 12/807,808 filed on Sep. 14, 2010 which is a C-I-P of 12/217,756, filed on Jul. 8, 2008, now U.S. Pat. No. 7,793,728 is a division of Ser. No. 11/350,367 filed Feb. 8, 2006 which is now U.S. Pat. No. 7,395,865 which claims the benefit of provisional application Ser. No. 60/593,914 filed Feb. 24, 2005, each of which are incorporated herein by reference in their entirety.

BACKGROUND AND ART DISCUSSION

Plunger lift is a means for the removal of liquids from a gas well or an oil well wherein pressure of producing formation in the ground is utilized as the driving force for moving that plunger up and down in the well. The presence of liquid within that well, its production strain or tubing or casing, may be detrimental to the productive capacity of the well, as it exerts a back pressure on the formation limiting the flow into the well bore. The plunger lift is one of the several arrangements commonly known as "artificial lift", which arrangements are used to remove accumulated liquid from the well bore.

Production of an oil or gas well is optimized and theoretically achieved when all the liquids in the well are removed, and no back pressure is exerted on the formation at the base of the well. The plunger lift is an intermittent method of removing the liquids, wherein the challenge is to cycle the plunger as often as possible, to remove liquids, while keeping the bottom hole flowing-pressure as low as possible and practical, while still maintaining production. To make a plunger or cycle to be as effective and efficient as possible, it is important that it reaches the bottom before the lift cycle is initiated.

As the flow rate and pressures decline in a well, the lifting efficiency declines geometrically. Before long the well begins to load up and log off. This is a condition whereby gas being produced by the formation can no longer carry the liquid being produced, to the surface. There are two reasons this occurs: one as liquid comes in contact with the wall of the production string of tubing friction occurs. The velocity of the liquid is slowed and some of the liquid adheres to the tubing wall creating a liquid film. This liquid does not reach the surface. As the flow velocity continues to slow, the gas phase can no longer support liquid in either slug form or droplet form. This liquid, along with the liquid film on the sides of the tubing, fall back to the bottom of the well. In a very aggravated situation there will be liquid in the bottom of the well with only a small amount of gas being produced at the surface. The produced gas must bubble through liquid at the bottom of the well and then float to the surface. Because of the low velocity, very little liquid, if any, is carried to the surface. The corresponding head of liquid in the bottom of the well exerts a back pressure against the producing formation in a value equivalent to its hydrostatic head, and eventually will terminate the well's ability to produce. A properly applied plunger lift system should be able to bring back such wells to life and make them extremely profitable once again.

Once the well begins to load with liquid, the least expensive way to keep it flowing is to use an intermitter. An intermitter is simply a controller at the surface, which is used to open and close the well, usually on a time signal. Using this technique the well is stop cocked by shutting it in for a period of time to allow it to build pressure. After sufficient pressure has been achieved, the intermitter opens the valve at the surface, allowing the well to flow into the flow line. Because of the extra pressure in the well from the shut-in period, the velocity in the production string of tubing is higher and some of the liquid is able to be brought to the surface. Intermitting may be an effective means of keeping a well unloaded, particularly if pressures and volumes are sufficiently high. Plunger lift arrangements use this same basic intermitting technique along with a free traveling plunger in the tubing string as an interface between the liquid phase and the gas phase. Because of the action of the plunger in the tubing, there is less than a 5% fluid fall-back rate over the entire length of the tubing string irrespective of well depth. As a result, the well may be operated at a lower bottom hole pressure as all liquid is removed from the well bore, thus enhancing production.

The plunger in the system is a device that freely travels from the bottom of the well to the surface and back again, as aforementioned. The plunger is used as a mechanical interface between the gas phase and the fluid phase in a well. With the well closed at the surface, the plunger rests at the bottom of the well on top of a downhole stop arrangement. When the well is opened at the surface, with all production being through the tubing, the well begins to flow and pressure in the tubing decreases. Because of trapped gas in the casing/tubing annulus remaining at a higher pressure than the tubing, the differential pressure between the two increases, the fluid level in the annulus decreases as the fluid is pushed downward where it u-tubes into the production tubing. As this occurs, the expansion properties of gas cause the plunger to move up the tubing string with a fluid load on top. A small amount of gas may bypass the plunger, but this is useful as it scours the tubing wall of fluid, keeping all of the fluid on top of the plunger. This small gas blow-by also helps lighten the liquid load on the top of the plunger so not as much pressure is required under the plunger for lifting. Virtually all of the fluid may be eliminated from the well which allows the well to flow at the lowest bottom hole pressure possible. Production is therefore optimized.

A lubricator is arranged at the surface on top of the well head. The purpose of the lubricator is to place the plunger in the well and retrieve the plunger from the well without having to kill the well or run special tools to obtain the plunger, such as using a wire line. A manual capture mechanism is arranged in the lubricator along with a heavy spring and bumper pad to absorb the shock of the plunger at the surface in the event it surfaces at high velocity. One or two motor valves are also part of the system at the surface. They are used to open and close the well and are operated by the controller. As the supply gas is placed on the motor valves diaphragm, the valve opens. When this gas is exhausted, thus removing the pressure, the motor valve closes. An internal spring in the valve causes it to remain closed when no gas pressure is applied to it. The system also includes a controller. The controller's function is to open or close the motor valve. This opening and closing allows for the control of the well pressure and for effective fluid removal therefrom. A plunger sensor circuit may also be utilized for controlling the system when the plunger lift is utilized.

Present operating systems for controlling a plunger lift arrangement utilize a sales valve at the surface, which valve is closed, wherein the plunger is released from the surface at its lubricator, and the plunger is dropped inside the production string of tubing, or in some cases a casing, with the intention to pass through the gas and liquid phases to the bottom of the well, where it is generally stopped by some means. Those means may be a bumper spring, a downhole stop, or a standing valve. The close time at the sale valve is selected based on: a) the experience on the part of the operator or their advisors; b) a calculated time using known or assumed fall rates for the plunger in a gas and a liquid; or, c) measured fall rates using a sonic listening device such as an Echometer®.

Frequently, the "close" time which allows the plunger to fall, is selected based on experience or a calculated fall rate. These times are then buffered by the addition of a safety factor, so that the operator feels certain that the plunger has dropped all the way to the bottom of the well. This procedure however may lose valuable production time going unused as well as limiting the amount of liquid removed which may otherwise impede the flow into the well bore from the formation.

Currently, the Echometer® or its equivalent can currently provide the means to calculate accurate times for the plunger to reach the bottom of the well. Such devices are dedicated specifically to determine down hole conditions such as plunger travel time, liquid levels, down hole pressures etc. They are designed to be used as an intermittent use diagnostic instrument and generally do not have the plunger lift system operating capability. U.S. Pat. No. 6,634,426, by McCoy et al provides for a calculation of the plunger position based upon sonic pulses and known geometry of the tubing such as connecting collars between standard lengths of tubing and using the resulting calculation for the plunger lift control. However, that technology to calculate that plunger position and provide an appropriate control has been very expensive for practical and widespread application.

It is an object of the present invention to provide a plunger system which permits the control of the timing of the well's operation to minimize non-production time and to maximize the fluid above the plunger during the upstroke of the plunger. The object also includes real time sensing of plunger velocity fed to a flow control valve on the surface for optimum fluid removal of fluid from the well.

BRIEF SUMMARY OF THE INVENTION

In a first aspect of the present invention, a plunger in a plunger lift system in an oil and gas well is vertically movable in the production tubing string of that well, and falls to the bottom of that production tubing and signals a controller at the well head at the top of the well that it has arrived at the bottom. The production tubing is arranged within an outer casing which casing extends and defines the depth of the well. The tubing does not extend the full length of the casing. When the controller at the well head is signaled to close the surface valve at the beginning of the "close-cycle" for this well, the plunger is caused to fall to the bottom of the well. Since the production valve is closed, pressure is building up in the bottom of the well. Once the plunger reaches the bottom of the tubing string, a sound signal is generated by the plunger to signal, via transmission through the tubing string wall in one preferred embodiment, to a sound sensor at the well head, to open the production valve to begin the production cycles as promptly as possible. That signal received at the top of the well from the plunger hitting the bottom of the tubing is thus used to initiate the next step in the production cycle of that well, which signal may be to change the system valve at the well head.

The first aspect of the present invention includes a plunger which is receivable within a lubricator in the wellhead. The plunger comprises an elongated member having an upper or fishing neck end, and here, a lower most typically hollow end. The lowermost and of the plunger of the present invention in a further embodiment, includes a sound generator disposed therewithin.

An elongated downhole stop is sent to the bottom of the tubing within the well casing prior to the plunger's travel therewithin. The downhole stop acts to quickly decelerate (and stop) the falling plunger within the tubing. Upon the lower end of the plunger striking the upper end of the downhole stop, the plunger in one embodiment makes the "raw" tubing wall-travelling noise, and in another embodiment, the sound generator in the lower end of the plunger is activated to make a noise which is transmitted as vibrations into the actual wall of the tubing. That sound wave created in the lower end of the tubing travels in the steel wall of that tubing up into the wellhead. A wellhead sensor picks up the sound wave in the metal of the tubing and signals a controller at the wellhead into appropriate action or inaction.

One type of sensor, for example, is an embedded accelerometer which is fixed as for example by being threadedly secured within the thickness of the wall itself, A further embodiment comprises for example, an accelerometer which is attached, as for example, by straps, to the outside wall of the tubing, to pick up those transmitted vibrations. Such a strapping attachment permits adaption of such as sensor to a wide variety of manufacturers well head structures.

Another aspect of the present invention includes a noise generator arranged within the upper end of the downhole stop. The noise generator in the downhole stop adds to and multiplies any sound created by the stoppage of the plunger, for transmission of a stronger sonic signal in the wall of the tubing up to the sensor in the wellhead.

A proper circuit sends the received, identified, deciphered, now modulated sonic signal to the controller, for real-time activation of the control valve at the wellhead. The signal received by the sensor instructs the controller as to the "real-time" analysis of time and velocity of travel and importantly, of the stoppage of the plunger in the tubing. The sensor and/or the controller may be tuned/programmed to receive and react to sound signals of a certain "signature", so as to open or actuate the motor valve when the real time bottoming signal of the plunger is reported/received/acted upon. The functioning cycle of the well may thus begin anew since the report from the plunger at the bottom of the well has been received by the controller. Minimization of the time from the plunger's stoppage at the bottom of the tubing to the initiation of the recycling of the wells operation maximizes the well's efficiency.

In a further aspect of the present invention, the plunger itself includes a signal generator for transmitting electromagnetic signals during its travel through the interconnected sections of the tubing string. Such tubing string is comprised of approximately 30 foot sections of pipe threadedly coupled together by sleeve-like couples or connectors. While the longitudinally adjacent sections of tubing pipe are longitudinally separated by about a fraction of an inch to an inch and a quarter, the sleeving couples at their junctures overlaps each adjacent end of the connected tube sections. Such an overlap increases the thickness of the metal (steel) thereat, creating for example, a magnetically perceptible increase in an inductive internal sensor arranged to be within the travelling plunger moving therewithin. The internal sensor within the plunger thus is caused to send a real time electromagnetic signal as the plunger passed/travels through the sequence of signal-enhancing coupled joints, to a receiver at the well head, reporting to the controller and overseeing the flow control valve, again providing real time data about the time, velocity and location of a plunger travelling within the well's tubing and to thus regulate at least the upstroke velocity of the plunger by controllably adjusting the flow control valve output for optimum fluid removal.

This aspect of the present invention permits a generation of a signal when the plunger reaches any of a plurality of known spaced-apart locations within the well, which are not necessarily at the bottom of the well. The signal would be received by the controller located on the surface of the well and used to initiate corrective action in the valves at the well head or trigger the next step in the well's operating cycle.

A principal feature of the present invention is the avoidance of any required calculation of a plunger position since the signal is generated only when the plunger reaches the bottom or a predetermined and known physical location within the confines of the well and or its tubing.

The operating cycle may then be immediately begun anew, such as to initiate the immediate opening of the sales valve to permit the plunger to be brought to the surface with any accompanying fluids/liquids.

Another aspect of the present invention resides in a multi-staged plunger arrangement, where at least two or more plungers are operated over specific intervals of tubing, each plunger having a set starting and ending point. The present invention provides a means for signaling the arrival of each plunger at each particular point in its tubing interval.

A plunger arrival signal at a particular location may be a passive signal, such as: a signal at a frequency on the cessation of such signal, which is present due to the natural spectrum emitted as a plunger falls through the production tubing, and received by a proper microphone or pickup device on the controller at the surface of the well; a signal that is generated by a device contained within the plunger, the device arranged to generate a specific frequency as the plunger reaches one more of its prescribed destinations.

In a further aspect of the present invention, the plunger may contact a device at a particular location to generate such a signal from that location external to the plunger as well.

A plunger arrival signal at a particular location may also be an active signal, such as: a signal generated by a powered device located within the plunger or by a "location" device alongside the well and received at the surface. This aspect of the present invention generates a frequency of a greater amplitude than a passive means, making it easier to detect at the surface, and thus allowing for a less sophisticated, less costly receiver; a signal generated upon plunger arrival at the bottom of the well, which signal is generated electrically or sonically and transmitted (wirelessly) via the casing or the tubing itself or a transmission within such tubing, annulus or casing, and to the controller on the surface of the well; a signal generated upon plunger arrival at a specific location, not necessarily the bottom of the well, and transmitted to the surface of the well via a wired connection to the controller at the surface.

The location of the device utilized to generate the signal may be in the plunger, the locating tool, such as the bumper spring, or a standing valve or the like, or a sensor placed in a separate location in, or on a preset known location in the well casing, or any combination of all of these.

The technique described for the present invention is unique in that it permits the real-time or near real-time signal generation of plunger arrival at a specific, predetermined location (s) which may be utilized to a begin the next step in the production cycle of the well. Incorporation of such a signal into the operating logic, software or firmware tuned to the specific range of plunger "signatures, sound frequencies or noise patterns" into a plunger lift controller is also considered a further aspect of the present invention.

The invention may thus comprise a plunger lift control system for improving the efficiency of an oil or gas well, the system comprising: a well tubing for receiving a plunger traveling therethrough; a plurality of plunger location sensors placed at a preset locations alongside the well tubing to transmit real time location signals of the plunger to a signal receiver and processor arranged with a controller at an upper location of the well. The system preferably includes at least one plunger containing at least one self-contained sensor activating member therewith. The plunger location sensors are preferably spaced apart at preset, known locations with respect to the well tubing. The plunger location sensors may in one embodiment, be preferably comprised of activatable induction coils arranged to transmit an electromagnetic signal to a receiver for the controller at the upper location of the well. A plurality of plungers may be concomitantly operable within the well tubing. The plunger may preferably include an optical device for generating photo-optical signals relative to the visual appearance of the inner walls of the tubing. The placement of the plurality of spaced apart sensors relative to the tubing string effectively generates a constant real time output of well conditions and plunger travel parameters during the movement and the stoppage of the plunger within the tubing string.

The invention thus comprises a plunger lift control system for improving the output efficiency of an oil or gas well by a real-time reporting arrangement, the system comprising: a tubing string having an upper end and a lower end, the tubing string arranged within a well casing for receiving a plunger traveling therethrough; a plunger having a sound generating arrangement therein, so as to transmit a "real-time" lower-end location signal from the plunger to a signal sensor and processor arranged in communication with a system controller at the upper end of the tubing.

The sound generating arrangement of the plunger may consist of the impact noise of the plunger striking the upper end of a downhole stop arranged in the bottom of the tubing string. The sound generating arrangement of the plunger may also consist of a triggered noise maker activated at the bottom of the tubing string. The signal sensor at the upper end of the tubing may be a "signature sensitive" microphone embedded within the wall of the upper end of the tubing string. The signal sensor at the upper end of the tubing preferably may also be a vibratory motion sensing accelerometer embedded within the wall of the upper end of the tubing string. The signal sensor at the upper end of the tubing string may also be attached to the outside of the wall of the upper end of the tubing string by a strap arrangement. The tubing string is comprised of a series of tubing sections matingly connected by sleeve coupling members, and wherein the sleeve coupling members or an attached collar member thereto, function as signal inducers when a signal generating plunger travels therethrough.

The invention thus also comprises a method of increasing the output efficiency of an oil or gas well by minimizing the time required to recycle a plunger travelling between an upper end of a multi-sectioned metal walled tubing string and a bottom end of the metal walled tubing string of that well, comprising the steps of: sending a plunger down the walled tubing string within a well casing to a bottom portion of the tubing; generating a signal upon the plunger's reaching the bottom of the tubing; transmitting the signal generated by the plunger at the bottom of the tubing though/along the metal wall of the tubing to the upper end of the tubing; receiving the transmitted signal by a sensor arranged at the upper end of the tubing; and reporting the received signal to a controller for the well, to immediately recycle the operating procedures of the well. The sensor arranged at the upper end of the tubing is preferably an accelerometer. The method may also include transmitting signals to the upper end of the tubing as the plunger passes through a matingly connected juncture or couple in the multi-sectioned metal walled tubing.

BRIEF DESCRIPTION OF THE DRAWINGS

The objects and advantages of the present invention will become more apparent when viewed in conjunction with the following drawings, in which.

DETAILED DESCRIPTION OF THE DRAWINGS

Figure 1:
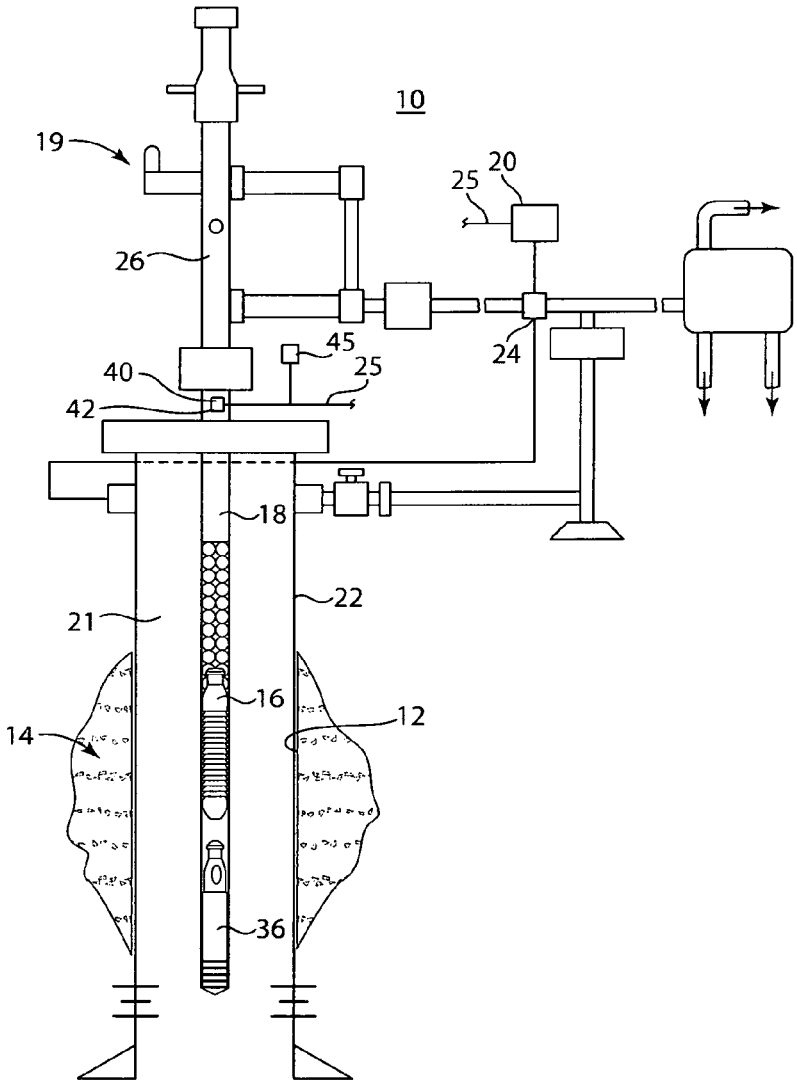
FIG. 1 represents a side elevation of view of a well plunger lift system of the present invention arranged into a formation in the ground for oil and gas production, with a wellhead controller shown at the surface of the well.

Referring now to the drawings in detail, and particularly to FIG. 1, there is shown a side view of an installed plunger lift control system 10 set up in a borehole 12 of a well 14. The plunger lift control system 10 includes a plunger arrangement 16. The plunger 16 in a plunger lift system in an oil and gas well is vertically movable in the production tubing string 18 of the well 14, and falls to the bottom of that production tubing string 18 and thence sends a signal "S" to a controller 20 with the wellhead 19 at the top of the well 14 that the plunger 16 has arrived at the bottom of the tubing string 18, identified by an arrangement described hereinbelow. The production tubing string 18 is arranged within an outer casing 22 which casing 22 extends and defines the depth of the well 14, there being an elongated annulus 21 between the tubing string 18 and the casing 22. The tubing string 18 does not extend the full length of the casing 22. The signal "S" received by a sensor 40 (described hereinbelow) at the top of the well from the "raw" noise-signal caused by the plunger 16 arriving at the bottom of the tubing string 18 during the valves' "closed" cycle, is then used to initiate the next step in the production cycle of that well 14, which raw noise signal "S" may be digitized by the sensor 40 and or the controller 20 and utilized to controllably open the system valve 24 at the well head initiating the plunger's upstroke.

Figure 2:
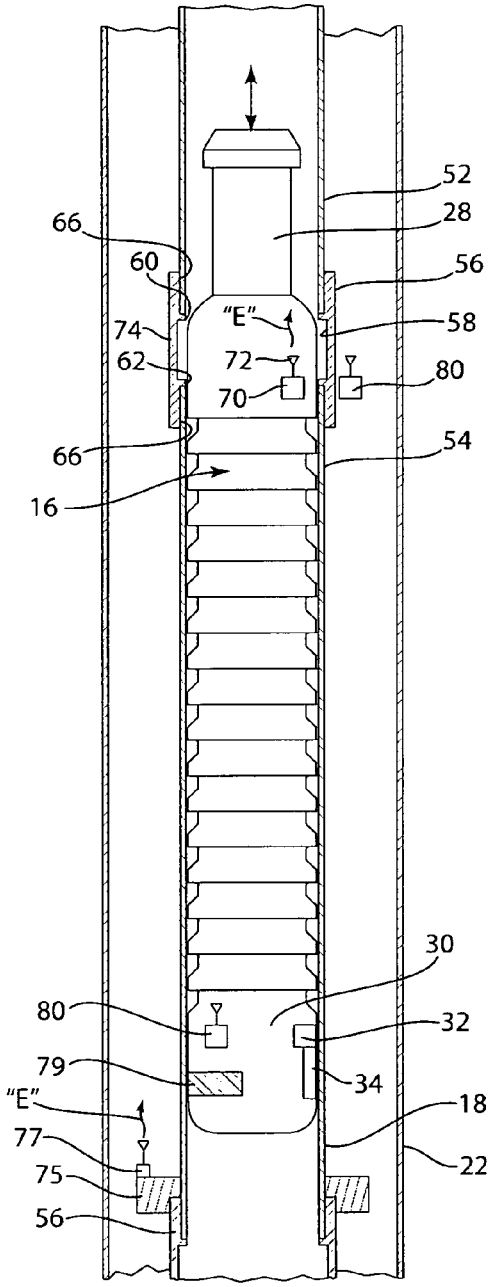
FIG. 2 shows a side elevation view of a plunger travelling within a well's string tubing in the well casing, showing longitudinally adjacent tubing sections matingly coupled together by a sleeve connector or couple, the plunger having further embodiments of signal generating means shown internally therewithin.

Another aspect of the present invention includes a plunger 16, shown in FIG. 1, and more specifically in FIG. 2, is receivable within a lubricator 26 in the wellhead 19. The plunger 16 comprises an elongated member having an upper or fishing neck end 28 and, shown here, a lowermost typically hollow end 30. The lowermost end 30 of the plunger 16 of the present invention, in one preferred embodiment, includes a sound generator 32 disposed therewithin. The sound generator 32 may be, for example, an impact-sensing, battery-empowered noise alarm, or a strike/impact triggered spring-loaded finger 34 or the like, which finger 34 is arranged to pivot and noisily strike the inside of the tubing string 18 and/or a portion of the downhole stop 36. The elongated downhole stop 36 is sent to the bottom of the tubing string within the well tubing 18 prior to the plunger's travel therewithin. The downhole stop 36 acts to quickly decelerate (and stop) the falling plunger 16 within the tubing 18. Upon the lower end of the plunger 18 striking the upper end of the downhole stop 36, the sound generator 32 in the lower end of the plunger 16 makes an impact or other generated noise which is transmitted as vibrations into and along the actual metal wall of the tubing 18. That sound wave signal "S" created in the lower end of the tubing 18 travels in the steel wall of that tubing 18 up into the wellhead 19. A wellhead sensor 40, as represented in FIG. 1, picks up the soundwave "S" in the metal of the tubing 18 and via a proper circuit 25, signals the controller 20 at the wellhead 19 into appropriate action or inaction. One type of sensor 40, for example, may be a frequency sensitive microphone or an embedded accelerometer which is fixed within the thickness of the wall of the tubing string 18 itself, for picking up, converting vibratory signals into electronic signals, and re-transmitting and filtering those signals in real time to the controller 20 through the circuit 25. A further embodiment comprises for example, an accelerometer 40 which is attached, as for example, by straps 42, to the outside wall of the tubing 18, to pick up those transmitted vibration signals "S". Such a strapping attachment 42 permits adaption of such a sensor 40 to a wide variety of manufacturers well head structures.

Figure 3:
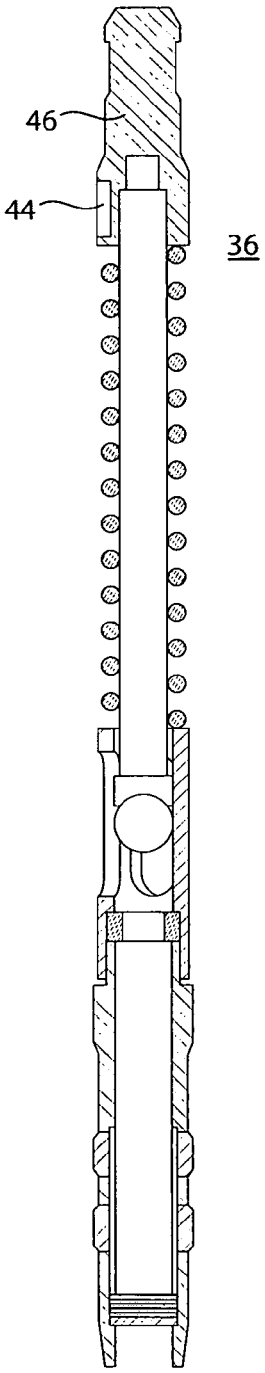
FIG. 3 representing a downhole stop in a longitudinal cross-sectional view, with signal generating means therewith.

Another aspect of the present invention may include a noise generator 44 (similar to the plunger's noise generator 32) arranged within the upper end 46 of the downhole stop 36, as shown in FIG. 3. The noise generator 44 in the downhole stop 36 would add to and multiply any sound signal "S" created by the stoppage of the plunger 16, for transmission of a stronger sonic signal "S" into the wall of the tubing string 18 and up to the sensor 40 in the wellhead 19.

A proper circuit 25 sends the received, identified, deciphered, now modulated sonic signal "S" to the controller 20, for activation of the flow control valve 24 at the wellhead 19, as represented in FIG. 1. The signal "S" received by the sensor 40 instructs the controller 20 as to the "real-time" analysis of time and velocity of travel and importantly, of the stoppage (arrival) of the plunger 16 in the lower end of the tubing string 18 thus signaling the ending of the "fall" cycle of the plunger 16 so that the well 14 may thus begin anew once the report from the plunger 16 at the bottom of the well has been received by the controller 20. Minimization of the time from the plunger's stoppage/arrival at the bottom of the tubing string 16 to the initiation of the recycling of the well's operation by utilizing real time analysis, thus maximizes the well's efficiency.

In a further aspect of the present invention, the plunger 16 includes a signal generator 70 for transmitting electromagnetic signals "S" during its travel through a series of interconnected sections 52 and 54 of the tubing string 18. The tubing string 18 is comprised of a plurality of approximately 30 foot sections 52 and 54 of pipe matingly coupled together by sleeve-like connectors or couples 56, as represented in FIG. 2. While the longitudinally adjacent sections 52 and 54 of tubing 18 pipe are typically separated by an annular gap 58 of a fraction of an inch to an inch and a quarter, the sleeving or couples 56 at their junctures overlaps each adjacent end 60 and 62 of the connected tube sections 52 and 54. Such an overlap increases the thickness of the metal (steel) as a close pair of thicker metal bands 66, creating for example, a magnetically perceptible increase in an empowered inductive internal sensor 70 carried within the travelling plunger 16 moving therewithin, as represented in FIG. 2. The internal sensor 70 within the plunger 16 thus is caused to send a real time electromagnetic signal "E" through a proper transmitter and an emitter antenna 72 as the plunger 16 passed/travels through the sequence of signal-enhancing coupled joints 74, to a receiver such as an rf sensor 45 which in this embodiment would be properly connected to the circuit 25 at the wellhead 19, again providing "real time" data about the time, velocity and location of a plunger 16 travelling within the tubing 18 of the well 14. The intent of the plunger 16 is to keep all of the fluid above the plunger during the plunger's upstroke. If the plunger moves too slowly, fluid will adhere to the wall of the tubing string and not all of the fluid will be driven to the surface. If the plunger rises too fast, fluid friction will increase causing drag. Thus velocity control of the plunger is important to the well's operation and efficiency A further aspect of the present invention comprises an annular signal ring 75, which signal ring 75 may include an induction coil and signal transmitter 77. Such signal rings 75 are installed by simply sliding them down onto each couple 56 as the sections of the tubing string 18 are sequentially threadedly assembled onto one another at particular longitudinal locations on that tubing string 18. The plunger 16 in this embodiment would include a magnetic member 77, which would induce a "location/time" signal "E" to be generated in the ring 75, and transmitted by transmitter 77 as the plunger 16 travelled therepast.

This aspect of the present invention permits a generation of an electromagnetic signal "E" when the plunger 16 reaches any of the plurality of known, spaced-apart locations junctures/joints 72 within the well 14, which are not necessarily at the bottom of the well 14. The signal "E" would be received by the controller 20 located on the surface of the well 14 and used to initiate corrective action in the valves 24 at the wellhead 10 or trigger the next step in the well's operating cycle.

Thus real time reporting of plunger velocity and position permits the flow control valve to be able to properly control the flow rate at the surface and thus permits optimum flow removal from the well.

Another principal feature of the present invention is thus also the avoidance of any required calculation of a plunger position since the signal is generated only when the plunger reaches a predetermined and known physical location within the confines of the well and or its tubing.

The operating cycle may then be immediately begun anew, such as to initiate the immediate opening of the sales valve to permit the plunger to be brought to the surface with any accompanying fluids/liquids as well.

Another aspect of the present invention resides in a multi-staged plunger arrangement, not shown for clarity, where at least two or more plungers are operated over a specific intervals of tubing, each plunger having a set starting and ending point. The present invention provides a means for signaling the arrival of each plunger at each particular point in its tubing interval.

The plunger arrival signal at a particular location may be a passive signal, such as: a signal at a frequency on the cessation of such signal, which is present due to the natural spectrum emitted as a plunger falls through the production tubing, and may be received by for example, a proper microphone or sensitive pickup device on the controller 20 at the surface of the well 14; a signal that is generated by a device contained within the plunger 16 as aforementioned, the device arranged to generate a specific frequency as the plunger reaches one more of its prescribed destinations.

The plunger arrival signal at a particular location may also be an active signal as aforementioned, such as: a signal generated by the powered device 70 located within the plunger 16 or a location device 80 alongside the well 14 and received at the surface. This aspect of the present invention generates a frequency of a greater amplitude than a passive means, making it easier to detect at the surface, and thus allowing for a less sophisticated, less costly receiver; a signal generated upon plunger arrival at the bottom of the well, which signal is generated electrically or sonically and transmitted (wirelessly) via the casing or the tubing itself or a transmission within such tubing or casing, and to the controller on the surface of the well; a signal generated upon plunger arrival at a specific location, not necessarily the bottom of the well, and transmitted to the surface of the well via a wired connection to the controller at the surface.

The location of the device utilized to generate the signal may be in the plunger, the locating tool, such as the bumper spring, or a standing valve or the like, or a sensor placed in a separate location in, or on a preset known location in the well tubing, or any combination of all of these.

The technique described for the present invention is unique in that it permits the real-time or near real time signal generation of plunger arrival at a specific, predetermined location (bottom) which may be utilized to begin the next step in the production cycle of the well. Incorporation of such a pre-identified signal into the operating logic, software or firmware of a plunger lift controller is also considered a further aspect of the present invention.

The invention may comprise a plunger lift control system for improving the efficiency of an oil or gas well, the system comprising: a well tubing for receiving a plunger traveling therethrough; a plurality of plunger location sensors placed at a preset locations alongside the well tubing to transmit real time location signals of the plunger to a signal receiver and processor arranged with a controller at an upper location of the well. The system in one embodiment preferably includes at least one plunger containing at least one self-contained sensor-activating member therewith.

The plunger location sensor triggers may be preferably spaced apart at preset, known locations with respect to the well tubing. The plunger location sensors may be preferably comprised of for example, juncture connecting sleeves or activatable induction coils at the juncture sleeves, arranged to transmit an electromagnetic signal to a receiver for the controller at the upper location of the well for reporting to the controller 26 and for regulation of the control valve 24.

A plurality of plungers in a further embodiment, may be concomitantly operable within the well tubing. The plunger 16 may include a photo-optical device 80 for generating signals relative to the visual appearance of the inner walls of the tubing 18. The placement of the plurality of spaced apart sensors relative to the tubing effectively generates a constant real time output of well conditions and plunger travel parameters during the movement and stoppage of the plunger within the casing.

We claim:

1. A plunger lift control system in a well head for improving the output efficiency of an oil or gas well by a real-time reporting arrangement, the system comprising:

a tubing string having an upper end and a lower end, the tubing string arranged within a well casing for receiving a plunger traveling therethrough;

a plunger and well casing arrangement having a well-position-sensing sound generating arrangement therein, so as to transmit a real-time lower-end location signal position-indicative signal from the plunger to a signal sensor and processor arranged in the upper end of the tubing string and in communication with a valve controlling system controller at the well head.

2. The plunger lift control system for improving the output efficiency of an oil or gas well as recited in claim 1, wherein the sound generating arrangement of the plunger consists of the impact noise of the plunger striking the upper end of a downhole stop arranged in the bottom of the tubing string.

3. The plunger lift control system for improving the output efficiency of an oil or gas well as recited in claim 1, wherein the sound generating arrangement of the plunger consists of a triggered noise maker activated upon arrival and impact at the bottom of the tubing string.

4. The plunger lift control system for improving the output efficiency of an oil or gas well as recited in claim 1, wherein the signal sensor at the upper end of the tubing is a microphone in embedded within the wall of the upper end of the tubing string.

5. The plunger lift control system for improving the output efficiency of an oil or gas well as recited in claim 1, wherein the signal sensor at the upper end of the tubing is a motion sensing accelerometer embedded within the wall of the upper end of the tubing string.

6. The plunger lift control system for improving the output efficiency of an oil or gas well as recited in claim 1, wherein the signal sensor at the upper end of the tubing is attached to the outside of the wall of the upper end of the tubing string by a strap arrangement.

7. The plunger lift control system for improving the output efficiency of an oil or gas well as recited in claim 1, wherein the tubing string is comprised of a series of tubing sections connected by sleeve member couples, and wherein the sleeve member couples function as signal inducers when a plunger travels therethrough.

8. The plunger lift control system for improving the output efficiency of an oil or gas well as recited in claim 7, wherein a signal ring rests upon an upper edge of the sleeve member couples.

9. The plunger lift control system for improving the output efficiency of an oil or gas well as recited in claim 8, wherein the signal ring has an inductive coil and signal transmitter arranged therein.

10. The plunger lift control system for improving the output efficiency of an oil or gas well as recited in claim 9, wherein the plunger has a magnetic member arranged therein so as to generate an electromagnetic impulse in the signal ring resting on a sleeve member couple and subsequent location signal generation for transmission to the sensor in the wellhead.

11. A method of increasing the output efficiency of an oil or gas well by minimizing the time required to recycle a plunger travelling between an upper end of a multi-sectioned metal walled tubing string and a bottom end of the metal walled tubing string of that well, comprising:

sending a plunger down the walled tubing string within a well casing to a bottom portion of the tubing;

generating an autonomous, location-induced signal upon the plunger's reaching the bottom of the tubing;

transmitting the autonomous, location-induced signal generated by the plunger at the bottom of the tubing though the metal wall of the tubing to the upper end of the tubing;

receiving the transmitted autonomous, location-induced signal by a sensor arranged at the upper end of the tubing; and reporting the received autonomous, location-induced signal to a controller for the well, to immediately recycle the operating procedures of the well.

12. The method as recited in claim 11, wherein the signal sent by the plunger reaching the bottom of the tubing string is a raw noise signal.

13. The method as recited in claim 11, wherein the sensor arranged at the upper end of the tubing is an accelerometer.

14. The method as recited in claim 11, including:

transmitting signals to the upper end of the tubing as the plunger passes through a juncture in the multi-sectioned metal walled tubing.

15. The method as recited in claim 11, wherein the plunger includes a magnetic signal generating member arranged therein so as to induce a signal within an induction coil resting on the sleeve couples connecting adjacent tubing string sections as the plunger passes therewithin.

16. A method of increasing the output efficiency of an oil or gas well by minimizing the time required to recycle a plunger travelling back and forth between an upper end of a multi-sectioned metal walled tubing string and a bottom end of the metal walled tubing string of that well, comprising:

sending a plunger down the walled tubing string within a well casing to a bottom portion of the tubing;

generating a raw impact signal upon the plunger's reaching the bottom of the tubing; and transmitting the raw signal generated by the plunger at the bottom of the tubing into and though the metal wall of the tubing to the upper end of the tubing for receipt and re-transmission to a control unit, by an accelerometer at the upper end of the tubing string.

17. The method as recited in claim 16, including:

transmitting a signal generated by the plunger during its upstroke through the tubing into through a signal generator carried by the plunger;

receiving the transmitted signals by a sensor arranged at the upper end of the tubing; and reporting the received signal to a system controller for the well, to permit immediately real time control the fluid flow rate from the well via control of a flow rate valve at the surface of the well.

18. The method as recited in claim 16, wherein the impact signal is generated by a battery empowered impact sensing noise generator.

* * * * *